United States Patent [19]

Goeury

[11] Patent Number: 4,948,673

[45] Date of Patent: Aug. 14, 1990

[54] PROTECTIVE PANEL, AND IN PARTICULAR A BALLISTIC SHIELD

[75] Inventor: Walter G. Goeury, Fontenay Les Briis, France

[73] Assignee: Compagnie Europeene D'Emballages Speciaux(S.A.), France

[21] Appl. No.: 180,516

[22] Filed: Apr. 12, 1988

[51] Int. Cl.[5] ..... B32S 27/00

[52] U.S. Cl. ..... 428/425.8; 428/425.6; 428/911

[58] Field of Search ..... 428/911, 425.8, 425.6

[56] References Cited

U.S. PATENT DOCUMENTS

| | | | |
|---|---|---|---|
| 4,061,815 | 3/1978 | Poole, Jr. | 428/911 |
| 4,079,464 | 3/1978 | Roggin | 428/911 |
| 4,307,140 | 12/1981 | Davis | 428/416 |
| 4,592,947 | 6/1986 | Hunter et al. | 428/425.6 |
| 4,666,758 | 5/1987 | Hunter | 428/426 |
| 4,719,151 | 1/1988 | Chyung et al. | 428/911 |
| 4,813,334 | 3/1989 | Bloks et al. | 428/911 |
| 4,876,941 | 10/1989 | Barnes | 428/911 |

*Primary Examiner*—Edith Buffalow

*Attorney, Agent, or Firm*—Thomas A. O'Rourke

[57] ABSTRACT

A multi-layer composite protective panel having layers of aluminum (1), a laminated composite (3), and a ceramic (b 5), which layers are glued together by an aliphatic polyurethane polyether resin (2, 4) having a Shore A hardness of about 75 and having a softening point of 125° C. The panel is particularly suitable for use as bullet-proof armor plating.

4 Claims, 1 Drawing Sheet

PROTECTIVE PANEL, AND IN PARTICULAR A BALLISTIC SHIELD

The present invention relates to a protective panel and in particular a ballistic shield (i.e. a shield for providing protection against bullets and other ballistic projectiles). Such a shield is intended, particularly, but not exclusively, for armor-plating bodywork, casings, protective shields, and in particular for armor-plating "thin" metal sheet such as that used in civilian industry for lining doors or for making motor vehicle bodywork.

BACKGROUND OF THE INVENTION

A whole range of solutions have already been proposed for the problem of armor-plating bodywork, however they all suffer from a major drawback they make use of materials which are heavy, thick, and usually made of metal, which often make this type of operation impossible, for example, on civilian vehicles whose structure and power are not up to the weight of such armor plating.

When armor-piercing bullets are used (i.e. bullets including an extremely sharp tungsten core covered in a lead alloy which is in turn covered in brass), the thickness of material that would be required is prohibitive.

In order to stop an armor-piercing projectile, it is already known that sintered industrial ceramics may be used, which ceramics may be based on alumina or on silica, serving to break the core such that immediately after penetrating it is no longer pointed but becomes blunted or may even disintegrate into several pieces. Such a core can then be stopped by a layer of composite armor plating of the Antigun (registered trademark) type or by any other light armor plating.

However, the problem which remains and which is solved by the present invention is the problem of cohesion in composite panels comprising the ceramic and either stainless steel, or aluminum, or else a panel of the Antigun type.

Glues are known which serve to hold together various layers with adequate adhesion. However, in the event of a violent shock such as a bullet impact, it turns out that the various layers come unstuck from one another. The shockwave produced in the event of a projectile impact may reach a speed of about 9,000 meters per second (m/sec), whereas the speed of the projectile is only 800 m/sec. This produces a corresponding change in volume which, independently of any mechanical effect shatters the layer of adhesive if it is hard, thereby deliminating or clearing apart the layers, and possibly causing the outer layer to fall off, if made of ceramic tiles. As a result, after impact, the ceramic tiles adjacent to the tile which receives the projectile either fall off or else are cracked, which leads to the use of an external retaining or protective layer so that the tiles are held in place after the impact of a projectile solely by the outer retaining layer.

French patent No. FR-A-2 565 162 describes a polyurethane which is laminateable at low temperature and which is intended to stick together two transparent layers such as glass and polycarbonate.

German patent No. DE-A-2 344 277 relates to a bullet-proof jacket comprising multi-layer plates constituted by a metal layer and a layer of inorganic material which are interconnected by a layer of elastomer such as rubber, polyurethane, PVC, etc. However, the purpose of this layer is solely to distribute energy and not to stick the layers together with the elastomer layer and the backing metal layer being bonded, for example, by glue.

In general, the structure of the materials used in armor plating is such that they are difficult to glue and are often held on their support, in particular if made of aluminum or stainless steel or of composite materials, solely by a suction effect.

The object of the present invention is to remedy this drawback and to enable panels to be made which withstand intensive firing at very short time intervals.

SUMMARY OF THE INVENTION

According to the present invention, a multi-layer protective panel is characterized in that the various layers are glued together by means of an aliphatic polyurethane whose Shore A hardness is 75 and whose softening point is 125° C.

It has been observed that for ballistic panels, the, or each, layer of adhesive should be relatively flexible in order to avoid coming unstuck after an impact.

According to another characteristic of the invention, the polyurethane is selected from the class of polyethers.

The physical characteristics of a polyether-urethane which has proved satisfactory are as follows:

| | |
|---|---|
| modulus of rupture: | 308 bars |
| modulus of elasticity under a tension of 10%: | 1.3 bars |
| modulus of elasticity under a tension of 100%: | 27 bars |
| modulus of elasticity under a tension of 300%: | 62 bars |
| elongation on rupture: | 500% |
| melting range: | 138° C. to 160° C. |
| density: | 1.15 |

The present invention also provides a method of manufacturing panels characterized in that it consists in heating the various layers of the panel in an oven for a period of about 45 minutes to a temperature lying between 150° C. and 200° C. until the edges of the polyether take on an amber tint, then in putting the assembly in a press to a pressure of 2 to 10 bars, and then allowing the assembly to cool in free air. Preferably, the temperature is increased gradually. The existence of bubbles of air in the layer of polyether does not prevent good gluing being obtained so there is no need to work under a vacuum.

The glue used is included against the layers to be bonded together in the form of a plastic film with a thickness lying between 0.38 mm and 1.25 mm, which film melts and spreads over the entire surface during heating and optionally fills in the interstices constituted, in particular, by ceramic tiles. The press ensures final cohesion of the various layers.

It may be observed that due to the relative flexibility of the glue, the shock resulting from the impact of a projectile on a tile is damped to such an extent that all the pieces of the broken tile remain glued either to the bottom layer or else to the intersticial layer. Similarly, adjacent tiles are not damaged.

BRIEF DESCRIPTION OF THE DRAWINGS

An embodiment of the invention is described by way of example with reference to the sole figure of the accompanying drawing which shows an armor-plating panel obtained by the method of the invention.

MORE DETAILED DESCRIPTION

Figure 1:
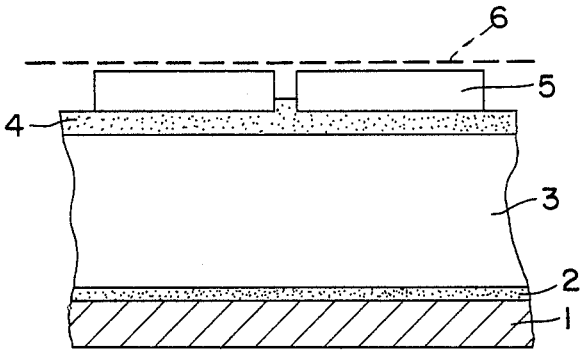

This panel is constituted going from the bottom to the top by: a layer 1 of aluminum connected by a layer 2 of adhesive to a panel 3 of composite material known under register trademark "ANTIGUN", as described in French patent No. FR-A-2 459 956, and constituted by a light core surrounded by layers of fiber, e.g. based on aramides embedded in a polyester resin. The Antigun panel supports ceramic tiles 5 by means of a layer of polyether resin glue 4. As shown in the FIGURE, the tiles 5 may themselves be covered with a light camouflage layer 6. In contrast to the prior art, this layer is not mechanically required for providing resistance to projectiles, and serves solely to hide the structure of the material.

EXAMPLES

COMPARISON OF TIMES IN MINUTES

Temperatures: 150° C. to 200° C.

| | | |
|---|---|---|
| 1. Test piece | 150 × 150 × 10<br>Antigun or similar<br>Aluminum or (stainless) steel<br>Ceramic | 30' |
| 2. Test piece | 150 × 150 × 10<br>Ceramic<br>Aluminum or stainless steel | 20' |
| 3. Test piece | 300 × 300 × 10 to 20<br>Ceramic<br>Antigun or similar<br>Aluminum or (stainless) steel | 45' |
| 4. Test piece | 300 × 300 × (1.5 + 1.5)<br>Stainless steel 1.5 mm thick<br>Glue<br>Stainless steel 1.5 mm thick | 30' |
| 5. Test piece | 300 × 300 × (1.5 + 0.7)<br>Stainless steel 1.5 mm thick<br>Glue<br>Aluminum 0.7 mm thick | 30' |

In the above examples, the term "(stainless) steel" is used as an abbreviation for "steel or stainless steel".

It is thus possible in accordance with the invention to glue together steel on steel, steel on rubber or similar materials, steel on Teflon or the like, even for applications other than armor plating, which has been substantially impossible in the past.

Naturally, numerous variants may be used, in particular by substituting technically equivalent means, without thereby going beyond the scope of the invention.

I claim:

1. A multi-layer protective panel having on one surface thereof ceramic tiles wherein the layers of said panel are adhered together by a glue comprising an aliphatic polyether polyurethane having a Shore A hardness of 75 and a softening point at about 125° C. and wherein said glue initially forms a film between said layers having a thickness of from about 0.38 mm to 1.25 mm prior to adhering the layers of said panel together.

2. A multi-layer protective panel according to claim 1 wherein the layers of said panel comprise a layer of metal selected from the group consisting of steel, stainless steel or aluminum, a layer of composite material having a core surrounded by layers of fiber and a layer of ceramic tiles.

3. A multi-layer protective panel according to claim 1 wherein said glue fills any interstices present between said ceramic tiles.

4. A multi-layer protective pane according to claim 1 wherein any shock resulting from the impact of a projectile on a tile is damped to such that the pieces of any tiles which have broken due to the impact remain adhered to said panel.

* * * * *